US006311626B1

(12) United States Patent
Roberts

(10) Patent No.: US 6,311,626 B1
(45) Date of Patent: Nov. 6, 2001

(54) HANGING STORAGE SHELF SYSTEM

(76) Inventor: Emmett Glenn Roberts, 107 Buttimer Ave., Frankfurt, KY (US) 40601-1830

( * ) Notice: Subject to any disclaimer, the term of this patent is extended or adjusted under 35 U.S.C. 154(b) by 0 days.

(21) Appl. No.: 09/612,111

(22) Filed: Jul. 7, 2000

(51) Int. Cl.[7] ..... A47B 23/00
(52) U.S. Cl. ..... 108/42; 211/113
(58) Field of Search ..... 108/42; 211/113, 211/118, 186; 52/39, 506.06, 764, 506.01, 506.07

(56) References Cited

U.S. PATENT DOCUMENTS

| | | | | |
|---|---|---|---|---|
| D. 349,000 | | 7/1994 | Rodgers et al. . | |
| 3,248,828 | * | 5/1966 | Shakelford | 108/42 X |
| 3,859,889 | * | 1/1975 | Fischer | 52/39 X |
| 3,863,879 | * | 2/1975 | Herb | 52/39 X |
| 4,188,890 | | 2/1980 | De Villers . | |
| 4,377,114 | | 3/1983 | Fuller . | |
| 4,441,583 | * | 4/1984 | Vaught | 211/113 X |
| 4,804,307 | | 2/1989 | Motoda . | |
| 5,199,843 | | 4/1993 | Sferra . | |
| 5,427,344 | | 6/1995 | Beauchemin . | |
| 5,522,577 | * | 6/1996 | Roesch | 52/39 X |
| 6,145,678 | * | 11/2000 | Morrison | 211/113 |

* cited by examiner

*Primary Examiner*—Jose V. Chen

(57) ABSTRACT

A hanging storage shelf system for hanging from a garage ceiling joist. The hanging storage shelf system includes a plurality of hanging rods for supporting a shelf from the ceiling. Each of the hanging rods has a first and a second end. Each of the first and second ends of the rods is threaded. The plurality of hanging rods comprises at least four hanging rods which are spaced such that a first, a second, a third and a fourth hanging rod define four corners of a rectangle. Each of the rods is releaseably screwed into ceiling joists. At least two bars connect pairs of hanging rods. The bars each have a first and second end having a bore therein. Each second end of the first and third rods is inserted in one of the bores of one of the bars, and each second end of the second and fourth bars is inserted in one of the bores of the other of the bars. A plurality of nuts holds the bars to the hanging rods. A shelf platform rests on the bars. The shelf platform has a pair of opposite edges, wherein one of the edges rests on one of the bars and the other of the edges rests on the other bar.

15 Claims, 3 Drawing Sheets

Fig. 5
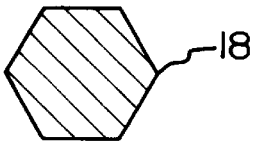
Fig. 6
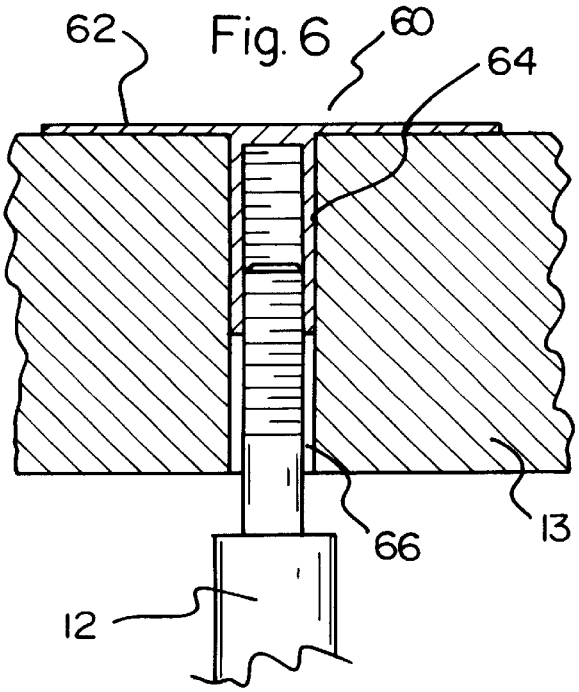
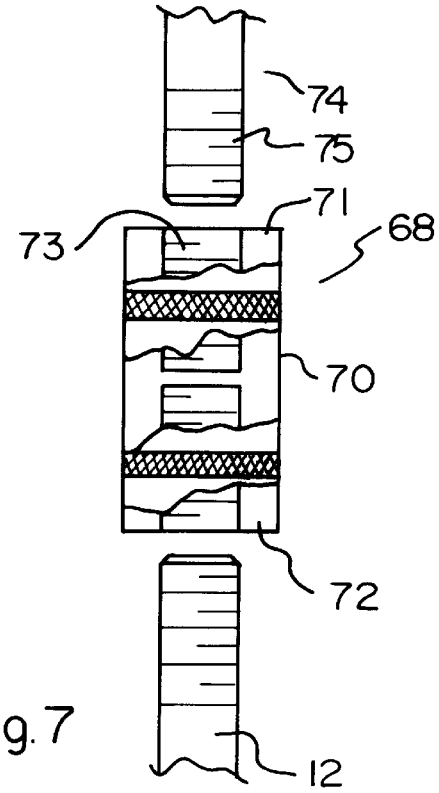
Fig. 7

HANGING STORAGE SHELF SYSTEM

BACKGROUND OF THE INVENTION

1. Field of the Invention

The present invention relates to shelving and more particularly pertains to a new hanging storage shelf system for hanging from a garage ceiling joist.

2. Description of the Prior Art

The use of shelving is known in the prior art. More specifically, shelving heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,377,114; U.S. Pat. No. 5,427,344; U.S. Pat. Des. No. 349,000; U.S. Pat. No. 4,188,890; U.S. Pat. No. 5,199,846; and U.S. Pat. No. 4,804,307.

While these devices fulfill their respective, particular objectives and requirements, the aforementioned patents do not disclose a new hanging storage shelf system. The inventive device includes a plurality of hanging rods for supporting a shelf from the ceiling. Each of the hanging rods has a first and a second end. Each of the first and second ends of the rods is threaded. The plurality of hanging rods comprises at least four hanging rods which are spaced such that a first, a second, a third and a fourth hanging rod define four corners of a rectangle. Each of the rods is releaseably screwed into ceiling joists. At least two bars connect pairs of hanging rods. The bars each have a first and second end having a bore therein. Each second end of the first and third rods is inserted in one of the bores of one of the bars, and each second end of the second and fourth bars is inserted in one of the bores of the other of the bars. A plurality of nuts holds the bars to the hanging rods. A shelf platform rests on the bars. The shelf platform has a pair of opposite edges, wherein one of the edges rests on one of the bars and the other of the edges rests on the other bar.

In these respects, the hanging storage shelf system according to the present invention substantially departs from the conventional concepts and designs of the prior art, and in so doing provides an apparatus primarily developed for the purpose of hanging from a garage ceiling joist.

SUMMARY OF THE INVENTION

In view of the foregoing disadvantages inherent in the known types of shelving now present in the prior art, the present invention provides a new hanging storage shelf system construction wherein the same can be utilized for hanging from a garage ceiling joist.

The general purpose of the present invention, which will be described subsequently in greater detail, is to provide a new hanging storage shelf system apparatus and method which has many of the advantages of the shelving mentioned heretofore and many novel features that result in a new hanging storage shelf system which is not anticipated, rendered obvious, suggested, or even implied by any of the prior art shelving, either alone or in any combination thereof.

To attain this, the present invention generally comprises a plurality of hanging rods for supporting a shelf from the ceiling. Each of the hanging rods has a first and a second end. Each of the first and second ends of the rods is threaded. The plurality of hanging rods comprises at least four hanging rods which are spaced such that a first, a second, a third and a fourth hanging rod define four corners of a rectangle. Each of the rods is releaseably screwed into ceiling joists. At least two bars connect pairs of hanging rods. The bars each have a first and second end having a bore therein. Each second end of the first and third rods is inserted in one of the bores of one of the bars, and each second end of the second and fourth bars is inserted in one of the bores of the other of the bars. A plurality of nuts holds the bars to the hanging rods. A shelf platform rests on the bars. The shelf platform has a pair of opposite edges, wherein one of the edges rests on one of the bars and the other of the edges rests on the other bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hanging storage shelf system apparatus and method which has many of the advantages of the shelving mentioned heretofore and many novel features that result in a new hanging storage shelf system which is not anticipated, rendered obvious, suggested, or even implied by any of the prior art shelving, either alone or in any combination thereof.

It is another object of the present invention to provide a new hanging storage shelf system which may be easily and efficiently manufactured and marketed.

It is a further object of the present invention to provide a new hanging storage shelf system which is of a durable and reliable construction.

An even further object of the present invention is to provide a new hanging storage shelf system which is susceptible of a low cost of manufacture with regard to both materials and labor, and which accordingly is then susceptible of low prices of sale to the consuming public, thereby making such hanging storage shelf system economically available to the buying public.

Still yet another object of the present invention is to provide a new hanging storage shelf system which provides in the apparatuses and methods of the prior art some of the advantages thereof, while simultaneously overcoming some of the disadvantages normally associated therewith.

Still another object of the present invention is to provide a new hanging storage shelf system for hanging from a garage ceiling joist.

Yet another object of the present invention is to provide a new hanging storage shelf system which includes a plurality of hanging rods for supporting a shelf from the ceiling. Each of the hanging rods has a first and a second end. Each of the first and second ends of the rods is threaded. The plurality of hanging rods comprises at least four hanging rods which are spaced such that a first, a second, a third and a fourth hanging rod define four corners of a rectangle. Each of the rods is releaseably screwed into ceiling joists. At least two bars connect pairs of hanging rods. The bars each have a first and second end having a bore therein. Each second end of the first and third rods is inserted in one of the bores of one of the bars, and each second end of the second and fourth bars is inserted in one of the bores of the other of the bars. A plurality of nuts holds the bars to the hanging rods. A shelf platform rests on the bars. The shelf platform has a pair of opposite edges, wherein one of the edges rests on one of the bars and the other of the edges rests on the other bar.

Still yet another object of the present invention is to provide a new hanging storage shelf system that can be extended to allow for lower shelves in relation to the ceiling.

Even still another object of the present invention is to provide a new hanging storage shelf system that has an extendable length by adding additional hanging rods and bars connecting pairs of such.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic cross-sectional view of the gripping portion taken along line 5—5 of the present invention.

FIG. 6 is a schematic side view of the mounting of the second embodiment of the present invention.

FIG. 7 is a schematic side view of the extension system of the present invention.

DESCRIPTION OF THE PREFERRED EMBODIMENT

Figure 1:
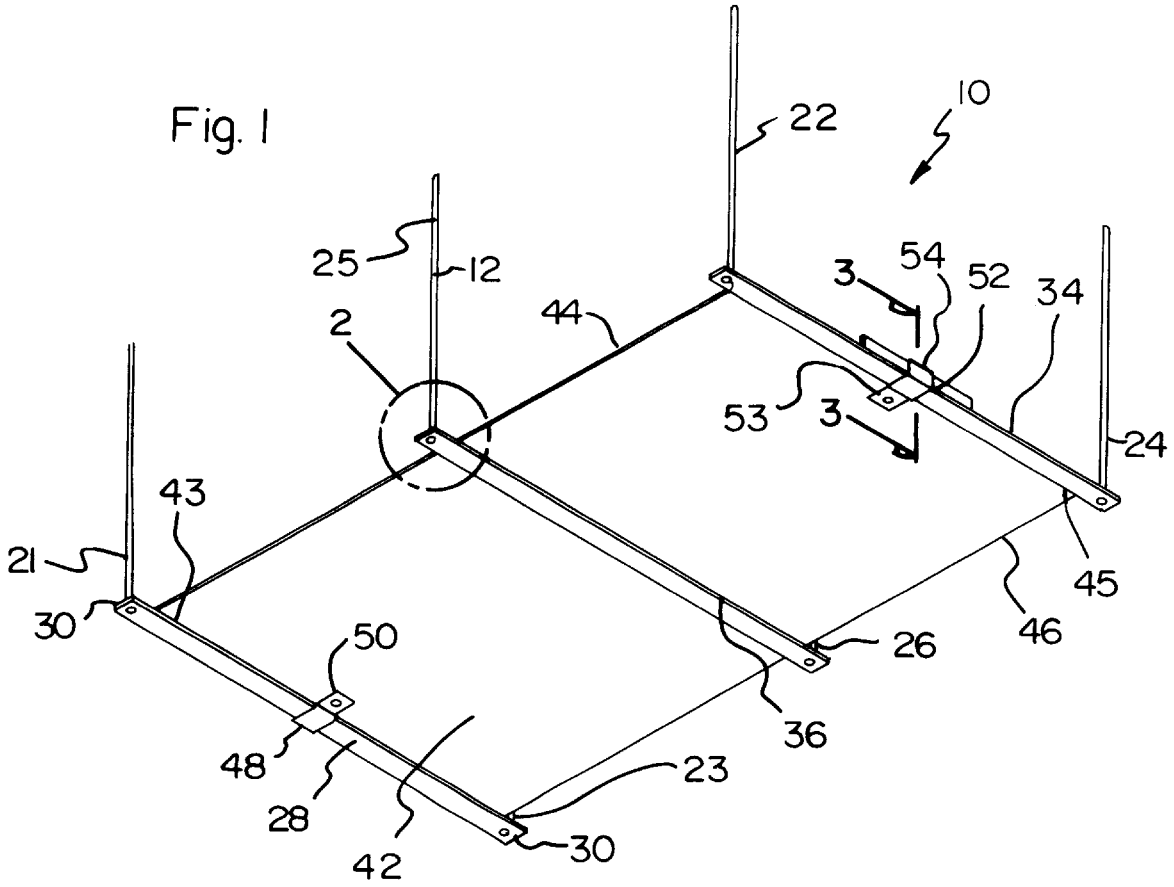
FIG. 1 is a schematic perspective view of a new hanging storage shelf system according to the present invention.
Figure 2:
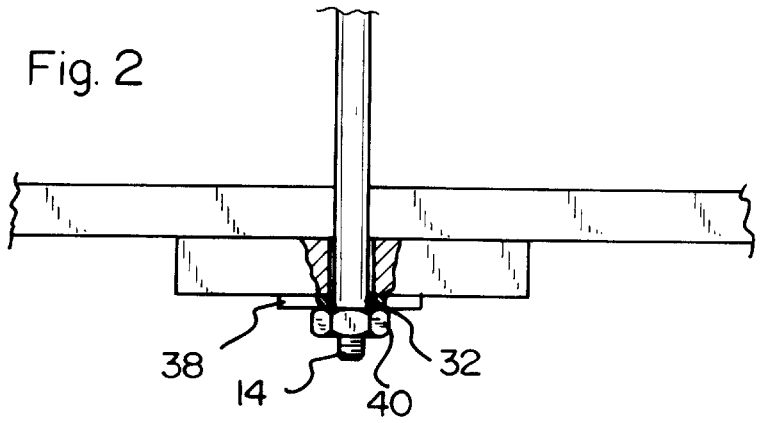
FIG. 2 is a schematic side view of the present invention.
Figure 3:
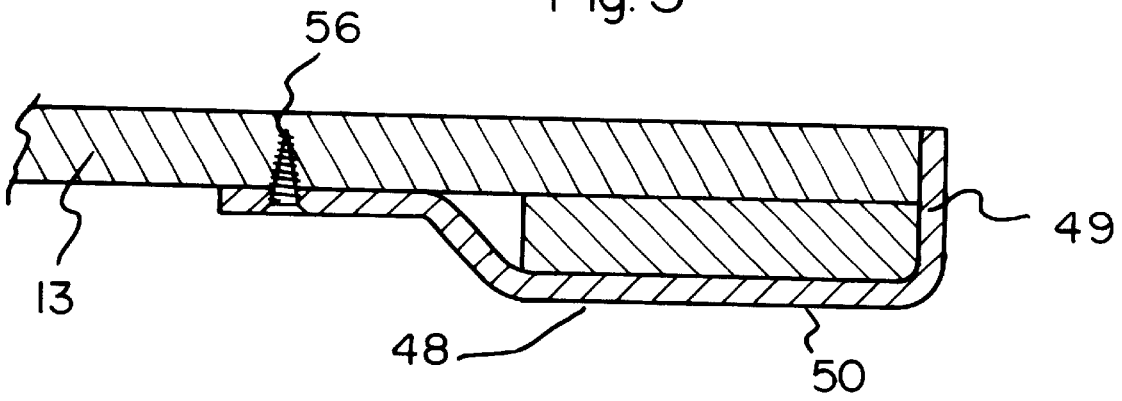
FIG. 3 is a schematic cross-sectional view taken along line 3—3 of the present invention.
Figure 4:
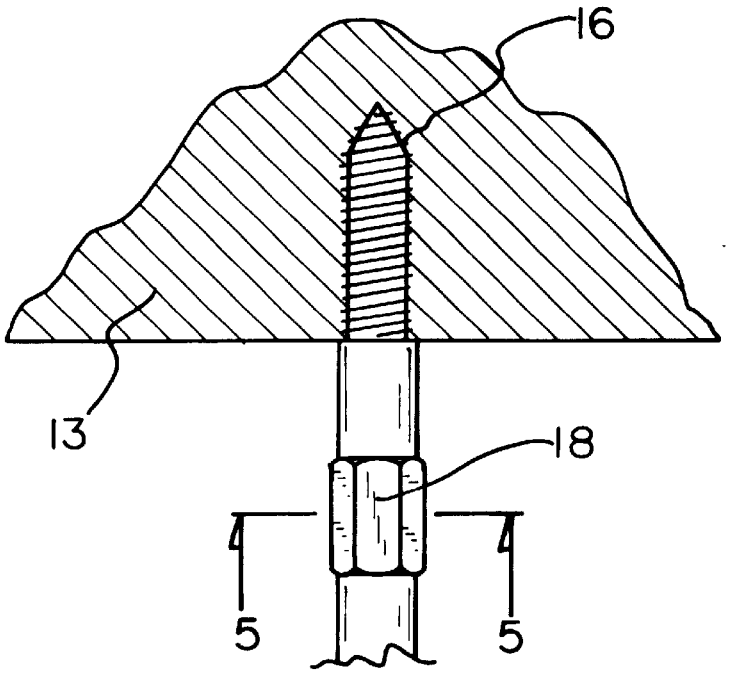
FIG. 4 is a schematic side view of the hanging rod entering a joist of the present invention.

With reference now to the drawings, and in particular to FIGS. 1 through 7 thereof, a new hanging storage shelf system embodying the principles and concepts of the present invention and generally designated by the reference numeral 10 will be described.

As best illustrated in FIGS. 1 through 7, the hanging storage shelf system 10 generally comprises a plurality of hanging rods 12 for hanging a shelf from a ceiling. Each of the hanging rods 12 has a first 16 and a second end 14. Each of the first 14 and second ends 16 of the rods 12 is threaded. Preferably, each of the first ends 16 of the hanging rods is conical and has a pointed tip. The rods hanging 12 have a generally annular shaped cross-section taken transverse to a longitudinal axes of the hanging rods 12.

Ideally, the hanging rods 12 have a gripping portion 18 for engaging a tool for rotating the hanging rod 12 for screwing the first end 16 of the hanging rod 12 into the ceiling. Preferably, each of the gripping portions 18 has a generally hexagonal shaped crosssection taken transverse to the longitudinal axis of the hanging rod 12. The gripping portions 18 are generally adjacent to the first ends 16 of the hanging rods 12.

Ideally, the plurality of hanging rods 12 comprises at least six hanging rods. The hanging rods are spaced such that a first 21, a second 22, a third 23 and a fourth 24 hanging rod define four corners of a rectangle. The fifth 25 and sixth 26 hanging rods are on opposites sides of the rectangle. The fifth rod 25 is located between the first 21 and second rod 22. The sixth rod 26 is located between the third 23 and fourth rod 24. The fifth 25 and sixth 26 hanging rods each are generally equidistant from the hanging rods defining their side of the rectangle. All six hanging rods 12 are releaseably screwed into the ceiling. The ceiling comprises ceiling joists 13.

A first bar 28 connects a pair of hanging rods 12. The first bar has two ends 30. The first bar 28 has a pair of bores 32 therein. Each of the bores 32 is generally adjacent to one of the ends 30 of the first bar 28. Each of the second ends 14 of the first 21 and third 23 hanging rods is inserted in one of the bores 32. The first bar 28 has a generally rectangular shaped cross-section taken transverse to a longitudinal axis of the first bar. The first bar 28 has a flat upper surface on which a shelf may be rested.

A second bar 34 and a third bar 36 connect pairs of hanging rods. The second 34 and the third bars 36 each are substantially identical to the first bar 28. Each of the second ends 14 of the second 22 and fourth 24 hanging rods 12 is inserted through one of the bores 32 in the second bar 34. Each of the second ends of the fifth 25 and sixth 26 hanging rods 12 is inserted through one of the bores 32 in the third bar 36 such that a longitudinal axis of the second bar 34 is oriented generally parallel to a longitudinal axis of the third bar 36 and the first bar 28.

A plurality of washers 38 is placed over each of the second ends 14 of the hanging rods 12. One of the washers 38 is placed over each of the second ends 14 of the hanging rods 12 such that each is between the second end 14 of the hanging rod 12 and the respective bar.

A plurality of nuts 40 hold the bars to the hanging rods 12. One of the nuts 40 is secured on each of the second ends 14 of the hanging rods 12.

A shelf platform 42 rests on the bars. The shelf platform has a first 43, a second 44, a third 45 and a fourth 46 edge.

The first 43 and third edges 45 are opposite edges, and the second 44 and the fourth 46 are opposite edges. The first edge 43 of the shelf platform rests on the first bar 28. The third edge 45 of the shelf platform rests on the second bar 34. The shelf platform has a generally rectangular shape. Ideally, a length between the second 44 and fourth 46 edges is less than a length between the bores 32 on the first bar 28.

A first bracket 48 resists movement of the shelf platform 42 relative to the first bar 28. The first bracket has a generally L-shape. The bracket comprises a short portion 49 and a long portion 50. The long portion 50 extends toward the second bar 34. The short portion 49 extends toward the ceiling. A juncture of the short 49 and long portions 50 of the first bracket 48 is abutted against a corner of the first bar 28. The long portion 50 of the first bracket 48 has a bore therein.

A second bracket 52 resists movement of the shelf platform 42 relative to the second bar 34. The second bracket 52 is substantially identical to the first bracket. A long portion 53 of the second bracket extends toward the first bar 28. A juncture of the short 54 and long portions 53 of the second bracket 52 is abutted against a corner of the second bar 34.

A pair of screws 56 secures the first 48 and second 52 brackets to the platform 42. One of the screws 56 is in each of the bores. The screws 56 are removably secured in the platform 42.

A second embodiment for mounting the invention is best depicted in FIG. 6. The second embodiment contains a plurality of mountings 60 for holding the first ends 16 of the hanging rods 12. Each of the mountings has a plate 62. Each of the plates 62 has a hollow tube 64 fixedly coupled thereto. The interiors of the tubes are threaded and each tube 64 has an open end. The tube 64 is oriented generally perpendicular to the plate 62.

A plurality of bores 66 for receiving the tubes of the mountings extends through the ceiling joists 13.

Each of the plates 60 is placed on an upper surface of the ceiling joists 13 such that one of the tubes 64 extends downward into each of the bores 66. One of the first ends 16 of the hanging rods 12 is inserted into each of the tubes 64 through the bore 66.

Extension rods 68 can be used with both embodiments of the invention. The extension rods are best depicted in FIG. 7. The extensions rods include a plurality of first extension rods 70 for extending the length of the hanging rods. Each of the first extension rods has a first end 71 and a second end 72. Each of the ends has a bore 73 therein. The bores in the first extension rods 70 are threaded.

A plurality of second extension rods 74 for coupling the first extension rods 70 to the mountings 60. Each of the second extension rods 74 has a first end, not shown, and second end 75 which is threaded.

The first ends of the second extension rods 74 are adapted to be inserted in the tubes 64 of the mountings or screwed into a ceiling joist 13. The second ends 75 of the second extension rods 74 are adapted to be inserted in the second ends 71 of the first extension rods 70. The first ends 16 of the hanging rods 12 are adapted to be inserted in the second ends 72 of the first extension rods 70.

In use, the hanging rods 12 are inserted into the ceiling joists 13 either by screwing them directly into the joists or by coupling them to the mountings 60. Bars are hung between the hanging rods 12 to form scaffolding which can hold a shelf platform 42. The shelf platform 42 is secured to the bars to prevent it from sliding off the bar. Extension rods 70 can be added to lower the shelf.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hanging storage shelf system for hanging a shelf from ceiling joists of a ceiling, said system comprising:

a plurality of hanging rods for supporting a shelf from the ceiling, each of said hanging rods having a first and a second end, each of said first and second ends of said rods being threaded;

wherein said plurality of hanging rods comprises at least four hanging rods, said hanging rods being spaced such that a first, a second, a third and a fourth hanging rod define four corners of a rectangle, wherein each of said rods is releaseably screwed into the ceiling joists;

at least two bars for connecting said hanging rods, said bars each having a first and second end having a bore therein, wherein each second end of said first and third rods is inserted in one of said bores of one of said bars, wherein each second end of said second and fourth bars is inserted in one of said bores of the other of said bars;

a plurality of nuts for holding said bars to said hanging rods, one of said nuts being secured on each of said second ends of said hanging rods;

a shelf platform for resting on said bars, said shelf platform having a pair of opposite edges, wherein one of said edges rests on one of said bars and the other of said edges rests on the other bar;

a plurality of mountings for holding said first ends of said hanging rods, each of said mountings having a plate, each of said plates having a tube fixedly coupled thereto, each of said tubes being hollow with a threaded interior surface and an open end, said tube being oriented generally perpendicular to said plate;

a plurality of bores for receiving said tubes of said mountings, said bores being through said ceiling joists; and wherein each of said plates is positionable on an upper surface of said ceiling joists such that one of said tube extends downward into each of said bores, wherein one of said first ends of said hanging rods is insertable into each of said tubes through said bore.

2. The hanging storage shelf system as in claim 1, further comprising:

a plurality of first extension rods for extending the length of said hanging rods, each of said first extension rods having a first end and a second end, each of said ends having a bore therein, each of said bores being threaded;

a plurality of second extension rods for coupling said first extension rods to said mountings, each of said second extension rods having a first and second end, each of said first and second ends of said second extension rods being threaded; and wherein the first ends of said second extension rods are adapted to be inserted in said tubes of said mountings, wherein the second ends of the second extension rods are adapted to be inserted in said second ends of said first extension rods, wherein said first ends of said hanging rods are adapted to be inserted in said second ends of said first extension rods.

3. The hanging storage shelf system as in claim 1, wherein said hanging rods further comprise:

each of said first and second ends of said rods being threaded, each of said first ends of said hanging rods being conical and having a pointed tip, each of said rods having a generally annular shaped cross-section taken transverse to a longitudinal axes of said hanging rods.

4. The hanging storage shelf system as in claim 1, further comprising:

a gripping portion on each of said hanging rods for being engaged by a tool for rotating said hanging rod for screwing the first end of the hanging rod into the ceiling, each of said gripping portions having a generally hexagonal shaped cross-section taken transverse to a longitudinal axis of said hanging rod.

5. The hanging storage shelf system as in claim 1, further comprising:

wherein said plurality of hanging rods comprises at least six hanging rods, a fifth and a sixth hanging rod being on opposites sides of said rectangle, said fifth rod being located between said first and second rod, said sixth rod being located between said third and fourth rod, said fifth and sixth hanging rod each being generally equidistant from the hanging rods defining their side of said rectangle, wherein each of said six hanging rods is releaseably screwed into the ceiling joists.

6. The hanging storage shelf system as in claim 5, further comprising:

a bar for connecting said fifth and sixth hanging rods, said bar being generally identical to the other two of said bars, wherein each of said second ends of said fifth and sixth hanging rods is inserted in one of said bores, wherein all three bars have a longitudinal axis oriented generally parallel to each other.

7. The hanging storage shelf system as in claim 6, wherein said bars further comprise:

each of said bars having a generally rectangular shaped cross-section taken transverse to a longitudinal axis of said bars, each of said bars having a flat upper surface on which a shelf may be rested.

8. The hanging storage shelf system as in claim 6, further comprising:

a first bracket for resisting movement of the shelf platform relative to a first said bars, said first bracket having a generally L-shape, said bracket comprises a short portion and a long portion, said long portion extending toward a second of said bars, said short portion extending toward the ceiling, wherein a juncture of said short and long portions of said first bracket is abutted against a corner of said first bar, said long portion of said first bracket having a bore therein;

a second bracket for resisting movement of the shelf platform relative to the second bar, said second bracket being substantially identical to said first bracket, wherein a long portion of said second bracket extends toward said first bar, wherein a juncture of said short and long portions of said second bracket is abutted against a corner of said second bar; and a pair of screws for securing said first and second brackets to said platform, one of said screws being in each of said bores, said screws being removably secured in said platform.

9. A hanging storage shelf system for hanging a shelf from ceiling joists in a ceiling, said system comprising:

a plurality of hanging rods for hanging a shelf from a ceiling, each of said hanging rods having a first and a second end, each of said first and second ends of said rods being threaded, each of said first ends of said hanging rods being conical and having a pointed tip, each of said rods having a generally annular shaped cross-section taken transverse to a longitudinal axes of said hanging rods;

a gripping portion on each of said hanging rods for being engaged by a tool for rotating said hanging rod for screwing the first end of the hanging rod into the ceiling, each of said gripping portions having a generally hexagonal shaped cross-section taken transverse to said longitudinal axis of said hanging rod, each of said gripping portions being generally adjacent to said first ends of said hanging rods;

wherein said plurality of hanging rods comprises at least six hanging rods, said hanging rods being spaced such that a first, a second, a third and a fourth hanging rod define four corners of a rectangle, a fifth and a sixth hanging rod being on opposites sides of said rectangle, said fifth rod being located between said first and second rod, said sixth rod being located between said third and fourth rod, said fifth and sixth hanging rod each being generally equidistant from the hanging rods defining their side of said rectangle, wherein each of said six hanging rods is releaseably screwed into the ceiling, wherein the ceiling comprises ceiling joists;

a first bar for connecting a pair of hanging rods, said first bar having two ends, said first bar having a pair of bores therein, each of said bores being generally adjacent to one of said ends of said first bar, wherein each of said second ends of said first and third hanging rods is inserted in one of said bores, said first bar having a generally rectangular shaped cross-section taken transverse to a longitudinal axis of said first bar, said first bar having a flat upper surface on which a shelf may be rested;

a second bar and a third bar for connecting said hanging rods, said second and said third bars each being substantially identical to said first bar, wherein each of said second ends of said second and fourth hanging rods is inserted through one of said bores in said second bar, wherein each of said second ends of said fifth and sixth hanging rods is inserted through one of said bores in said third bar such that a longitudinal axis of said second bar is oriented generally parallel to a longitudinal axis of said third bar and said first bar;

a plurality of washers for placement over each of said second ends of said hanging rods, one of said washers being placed over each of said second ends of said hanging rods, each of said washers being between the second end of the hanging rod and the respective bar;

a plurality of nuts for holding said bars to said hanging rods, one of said nuts being secured on each of said second ends of said hanging rods;

a shelf platform for resting on said bars, said shelf platform having a first, a second, a third and a fourth edge, said first and third edges being opposite edges, said second and said fourth being opposite edges, said first edge of said shelf platform resting on said first bar, said third edge of said self platform resting on said second bar, said shelf platform having a generally rectangular shape, a length between said second and fourth edges being less than a length between said bores on said first bar;

a first bracket for resisting movement of the shelf platform relative to the first bar, said first bracket having a generally L-shape, said bracket comprises a short portion and a long portion, said long portion extending toward said second bar, said short portion extending toward the ceiling, wherein a juncture of said short and long portions of said first bracket is abutted against a corner of said first bar, said long portion of said first bracket having a bore therein;

a second bracket for resisting movement of the shelf platform relative to the second bar, said second bracket being substantially identical to said first bracket, wherein a long portion of said second bracket extends toward said first bar, wherein a juncture of said short and long portions of said second bracket is abutted against a corner of said second bar; and a pair of screws for securing said first and second brackets to said platform, one of said screws being in each of said bores, said screws being removably secured in said platform.

10. A hanging storage shelf system for hanging a shelf from ceiling joists of a ceiling, said system comprising:

a plurality of hanging rods for supporting a shelf from the ceiling, each of said hanging rods having a first and a second end, each of said first and second ends of said rods being threaded;

wherein said plurality of hanging rods comprises at least four hanging rods, said hanging rods being spaced such that a first, a second, a third and a fourth hanging rod define four corners of a rectangle, wherein each of said rods is releaseably screwed into the ceiling joists;

at least two bars for connecting said hanging rods, said bars each having a first and second end having a bore therein, wherein each second end of said first and third rods is inserted in one of said bores of one of said bars, wherein each second end of said second and fourth bars is inserted in one of said bores of the other of said bars;

a plurality of nuts for holding said bars to said hanging rods, one of said nuts being secured on each of said second ends of said hanging rods;

a shelf platform for resting on said bars, said shelf platform having a pair of opposite edges, wherein one of said edges rests on one of said bars and the other of said edges rests on the other bar;

wherein said plurality of hanging rods comprises at least six hanging rods, a fifth and a sixth hanging rod being on opposites sides of said rectangle, said fifth rod being located between said first and second rod, said sixth rod being located between said third and fourth rod, said fifth and sixth hanging rod each being generally equidistant from the hanging rods defining their side of said rectangle, wherein each of said six hanging rods is releaseably screwed into the ceiling joists.

a bar for connecting said fifth and sixth hanging rods, said bar being generally identically to the other two of said bars, wherein each of said second ends of said fifth and sixth hanging rods is inserted in one of said bores, wherein all three bars have a longitudinal axis oriented generally parallel to each other;

a first bracket for resisting movement of the shelf platform relative to a first said bars, said first bracket having a generally L-shape, said bracket comprises a short portion and a long portion, said long portion extending toward a second of said bars, said short portion extending toward the ceiling, wherein a juncture of said short and long portions of said first bracket is abutted against a corner of said first bar, said long portion of said first bracket having a bore therein;

a second bracket for resisting movement of the shelf platform relative to the second bar, said second bracket being substantially identical to said first bracket, wherein a long portion of said second bracket extends toward said first bar, wherein a juncture of said short and long portions of said second bracket is abutted against a corner of said second bar; and a pair of screws for securing said first and second brackets to said platform, one of said screws being in each of said bores, said screws being removably secured in said platform.

11. The hanging storage shelf system as in claim 10, further comprising:

a plurality of mountings for holding said first ends of said hanging rods, each of said mountings having a plate, each of said plates having a tube fixedly coupled thereto, each of said tubes being hollow, each of said tubes having a threaded interior surface, each of said tubes said tube having an open end, said tube being oriented generally perpendicular to said plate;

a plurality of bores for receiving said tubes of said mountings, said bores being through said ceiling joists; and wherein each of said plates is placed on an upper surface of said ceiling joists such that one of said tube extends downward into each of said bores, wherein one of said first ends of said hanging rods is inserted into each of said tubes through said bore.

12. The hanging storage shelf system as in claim 11, further comprising:

a plurality of first extension rods for extending the length of said hanging rods, each of said first extension rods having a first end and a second end, each of said ends having a bore therein, each of said bores being threaded;

a plurality of second extension rods for coupling said first extension rods to said mountings, each of said second extension rods having a first and second end, each of said first and second ends of said second extension rods being threaded; and wherein the first ends of said second extension rods are adapted to be inserted in said tubes of said mountings, wherein the second ends of the second extension rods are adapted to be inserted in said second ends of said first extension rods, wherein said first ends of said hanging rods are adapted to be inserted in said second ends of said first extension rods.

13. The hanging storage shelf system as in claim 10, wherein said hanging rods further comprise:

each of said first and second ends of said rods being threaded, each of said first ends of said hanging rods being conical and having a pointed tip, each of said rods having a generally annular shaped cross-section taken transverse to a longitudinal axes of said hanging rods.

14. The hanging storage shelf system as in claim 10, further comprising:

a gripping portion on each of said hanging rods for being engaged by a tool for rotating said hanging rod for screwing the first end of the hanging rod into the ceiling, each of said gripping portions having a generally hexagonal shaped cross-section taken transverse to a longitudinal axis of said hanging rod.

15. The hanging storage shelf system as in claim 10, wherein said bars further comprise:

each of said bars having a generally rectangular shaped cross-section taken transverse to a longitudinal axis of said bars, each of said bars having a flat upper surface on which a shelf may be rested.

* * * * *